US007064306B2

(12) United States Patent
Shin

(10) Patent No.: US 7,064,306 B2
(45) Date of Patent: Jun. 20, 2006

(54) INVERTER MICROWAVE OVEN AND METHOD FOR CONTROLLING THE SAME

(75) Inventor: Dong Myung Shin, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/916,426

(22) Filed: Aug. 12, 2004

(65) Prior Publication Data

US 2005/0121442 A1 Jun. 9, 2005

(30) Foreign Application Priority Data

Dec. 5, 2003 (KR) ..... 10-2003-0088086

(51) Int. Cl.
*H05B 6/66* (2006.01)
*H05B 6/68* (2006.01)

(52) U.S. Cl. ..... 219/715; 219/702; 219/718

(58) Field of Classification Search ..... 219/715, 219/716, 717, 718, 702
See application file for complete search history.

(56) References Cited

U.S. PATENT DOCUMENTS 4,777,575 A * 10/1988 Yamato et al. ..... 363/21.1
6,084,226 A * 7/2000 Greene et al. ..... 219/718
6,288,379 B1 * 9/2001 Greene et al. ..... 219/702
6,313,450 B1 * 11/2001 Han et al. ..... 219/702
6,448,541 B1 * 9/2002 Lim ..... 219/702
2004/0144773 A1 7/2004 Kim et al.
2004/0144776 A1 7/2004 Han et al.

FOREIGN PATENT DOCUMENTS

KR 10-2002-0010195 2/2002

OTHER PUBLICATIONS

English Language Abstract of KR 10-2002-0010195.

* cited by examiner

*Primary Examiner*—Daniel Robinson
(74) *Attorney, Agent, or Firm*—Greenblum & Bernstein, P.L.C.

(57) ABSTRACT

Disclosed herein are an inverter microwave oven and a method for controlling the same, wherein a switching frequency of an inverter is raised during the initial operation of the microwave oven and then lowered during the normal operation of the oven after the lapse of a predetermined time, so as to prevent overvoltage from being applied to a magnetron, which generates electromagnetic waves, during the initial operation, thereby enhancing durability and operational reliability of the inverter. The inverter microwave oven comprises a rectifier for rectifying and smoothing a commercial AC voltage into a DC voltage. The inverter is adapted to perform a switching operation based on the DC voltage from the rectifier to generate a magnetron drive AC voltage. The microwave oven further comprises a magnetron driver for converting the AC voltage from the inverter into a high-power DC voltage and applying the converted DC voltage to the magnetron, and an inverter control unit for varying the switching frequency of the inverter to prevent overvoltage from being applied to the magnetron.

12 Claims, 7 Drawing Sheets

INVERTER MICROWAVE OVEN AND METHOD FOR CONTROLLING THE SAME

BACKGROUND OF THE INVENTION

1. Field of the Invention

The present invention relates to an inverter microwave oven and a method for controlling the same, and more particularly to an inverter microwave oven and a method for controlling the same, wherein an inverter control unit is provided to vary a switching frequency of an inverter so as to prevent overvoltage from being applied to a magnetron during the initial operation of the microwave oven.

2. Description of the Related Art

FIG. 1 is a block diagram showing the construction of a conventional inverter microwave oven and FIG. 2 is a detailed block diagram of the conventional inverter microwave oven.

The microwave oven is generally adapted to position food in a cavity 1 and radiate electromagnetic waves to the food in the cavity 1 to heat it.

A magnetron M acts to generate the electromagnetic waves. In order to drive the magnetron M, a commercial alternating current (AC) voltage source 3 supplies a commercial AC voltage of 60 Hz to a general home, in which the microwave oven is installed, and an inverter 2 converts the commercial AC voltage from the commercial AC voltage source 3 into a high-power direct current (DC) voltage of about 3500V or more and supplies the converted DC voltage to the magnetron M.

In detail, the commercial AC voltage from the commercial AC voltage source 3 is rectified and converted into a DC voltage by a DC voltage source 4, composed of a bridge diode, and then inputted to a switching device 5. The switching device 5 performs a switching operation based on the DC voltage from the DC voltage source 4. To this end, the switching device 5 includes a plurality of switches turned on/off in response to the DC voltage from the DC voltage source 4 to generate a high-power AC voltage. This AC voltage from the switching device 5 is applied to a magnetron driver 6, which converts the AC voltage from the switching device 5 into a high-power DC voltage appropriate to the driving of the magnetron M and outputs the converted DC voltage to the magnetron M.

An inverter control unit 7 is further provided to control the switching operation of the switching device 5. The inverter control unit 7 includes a frequency generator 8 for generating a reference frequency varying with the output of the magnetron M under control of an output controller (not shown), and an inverter driver 9 for applying a switching control signal to the switching device 5 according to the frequency generated by the frequency generator 8 to control a switching frequency of the switching device 5.

However, the conventional inverter microwave oven with the above-mentioned construction has a disadvantage in that, if the frequency generated by the frequency generator is applied to the inverter driver during the initial operation of the microwave oven where there is no load on the magnetron, overvoltage is applied to the magnetron, resulting in degradation in durability of the inverter circuit.

In order to solve the above problem, it may be intended to raise the switching frequency of the inverter during the initial operation of the microwave oven. In this case, however, the drive voltage to the magnetron may become too low in level, causing a faulty operation of the magnetron.

SUMMARY OF THE INVENTION

Therefore, the present invention has been made in view of the above problems, and it is an object of the present invention to provide an inverter microwave oven and a method for controlling the same, wherein a switching frequency of an inverter is raised during the initial operation of the microwave oven and then lowered during the normal operation of the oven after the lapse of a predetermined time, so as to prevent overvoltage from being applied to a magnetron, which generates electromagnetic waves, during the initial operation, thereby enhancing durability and operational reliability of the inverter.

In accordance with an aspect of the present invention, the above and other objects can be accomplished by the provision of an inverter microwave oven comprising: a magnetron for generating electromagnetic waves; an inverter for performing a switching operation based on a direct current (DC) voltage into which a commercial alternating current (AC) voltage is rectified and smoothed, to generate a magnetron drive AC voltage, and applying the generated AC voltage to the magnetron; and inverter control means for varying a switching frequency of the inverter to prevent overvoltage from being applied to the magnetron.

Preferably, the inverter control means includes a soft drive circuit for softly driving a frequency IC to raise a frequency generated by the frequency IC during an initial operation of the microwave oven and lower the generated frequency after the lapse of a predetermined time.

The inverter control means may further include a feedback circuit responsive to the amount of current of the commercial AC voltage detected by an external current detector for raising the frequency generated by the frequency IC if the detected current amount is greater than a predetermined value and lowering the generated frequency if the detected current amount is smaller than the predetermined value.

In accordance with another aspect of the present invention, there is provided a method for controlling an inverter microwave oven, comprising the steps of: a) varying a switching frequency of an inverter with a level of a commercial AC voltage; b) lowering the switching frequency according to the amount of current flowing through a capacitor of an integrated circuit during an initial operation of the microwave oven; and c) operating the inverter at the switching frequency to generate a high-power AC voltage for driving of a magnetron.

Preferably, the step b) includes the steps of: b-1) detecting a voltage of the current flowing through the capacitor; and b-2) comparing the voltage detected at the step b-1) with a reference voltage, lowering the switching frequency if the detected voltage is higher in level than the reference voltage and raising the switching frequency if the detected voltage is lower in level than the reference voltage.

In a feature of the present invention, a switching frequency of an inverter is raised during the initial operation of a microwave oven and then lowered during the normal operation of the oven after the lapse of a predetermined time. Therefore, it is possible to enhance durability and reliability of the inverter circuit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
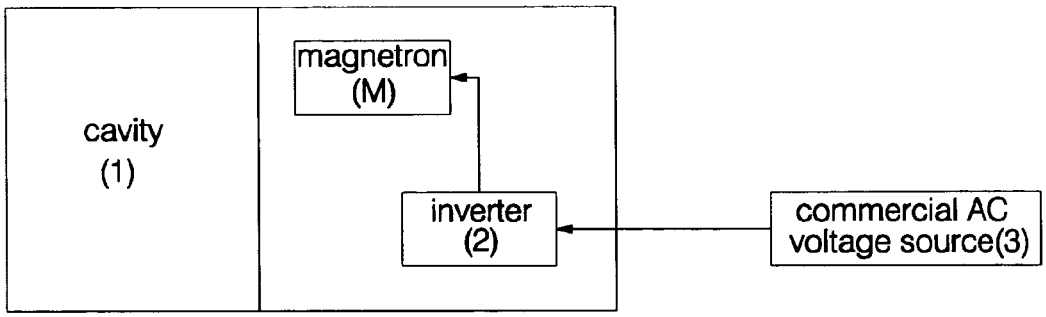
FIG. 1 (Prior Art)
FIG. 1 is a block diagram showing the construction of a conventional inverter microwave oven.
Figure 2:
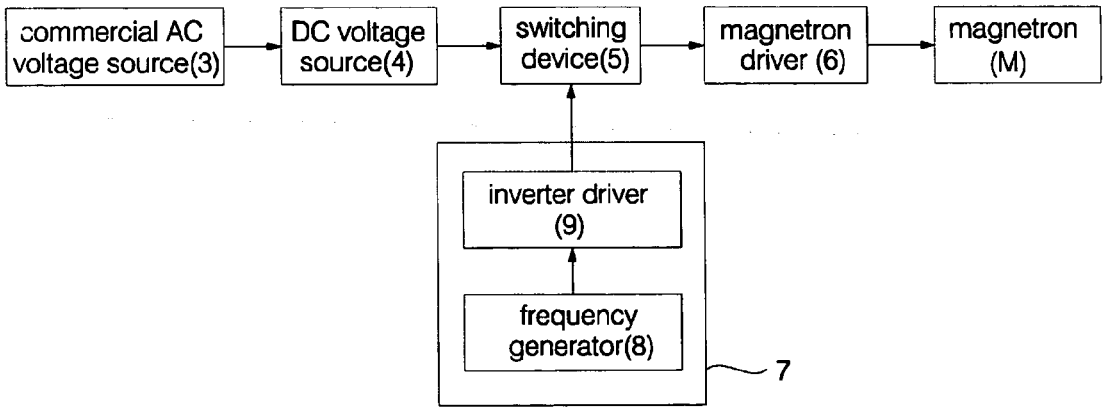
FIG. 2 (Prior Art)
FIG. 2 is a detailed block diagram of the conventional inverter microwave oven.
Figure 3:
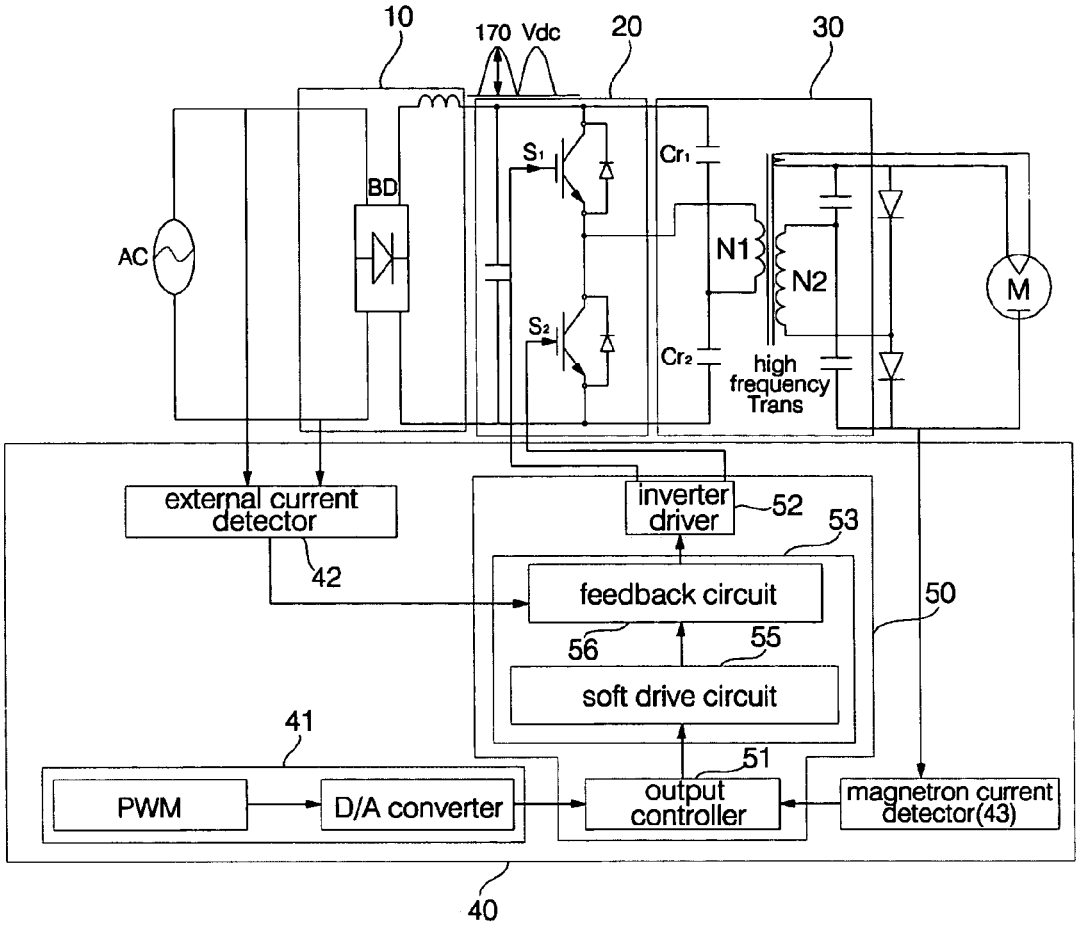
FIG. 3 is a detailed diagram of an inverter microwave oven according to the present invention.

FIG. 3 is a detailed diagram of an inverter microwave oven according to the present invention.

As shown in FIG. 3, the inverter microwave oven according to the present invention comprises a commercial AC voltage source AC for supplying a commercial AC voltage, a rectifier 10 for rectifying and smoothing the AC voltage from the AC voltage source AC to generate a ripple DC voltage of 120 Hz, an inverter 20 for performing a switching operation based on the DC voltage from the rectifier 10 to generate a magnetron drive AC voltage, and a magnetron driver 30 for converting the AC voltage from the inverter 20 into a high-power DC voltage and applying the converted DC voltage to a magnetron M.

The inverter microwave oven further comprises an inverter control unit 40 for varying a switching frequency of the inverter 20 to prevent overvoltage from being applied to the magnetron M.

The AC voltage source AC acts to supply a general commercial AC voltage (may have different values according to different countries although it has a value of 220V-60 Hz in Korea). The rectifier 10 acts to convert the AC voltage from the AC voltage source AC into a DC voltage. To this end, the rectifier 10 includes a bridge diode and a smoothing circuit.

The inverter control unit 40 includes a frequency generator 41 for generating a reference frequency, and a frequency controller 50 for varying the reference frequency generated by the frequency generator 41 to apply the high-power voltage to the magnetron M and raising the switching frequency of the inverter 20 during the initial operation of the microwave oven.

The inverter control unit 40 further includes an external current detector 42 for detecting the amount of current of the commercial AC voltage from the AC voltage source AC, and a magnetron current detector 43 for detecting the amount of current flowing through the magnetron M. With this configuration, the inverter control unit 40 enables the high-power voltage to be applied to the magnetron M.

The frequency controller 50 includes an output controller 51 for raising the reference frequency generated by the frequency generator 41 if the current amount detected by the magnetron current detector 43 is greater than a predetermined value and lowering the reference frequency if the detected current amount is smaller than the predetermined value, and a frequency-varying device 53 for varying the switching frequency of the inverter 20 according to the current amount detected by the external current detector 42.

The frequency controller 50 further includes an inverter driver 52 for applying a switching control signal to the inverter 20 in response to an output signal from the frequency-varying device 53 to control the switching frequency of the inverter 20 so as to drive the inverter 20.

The frequency-varying device 53 includes a frequency integrated circuit (IC) (not shown) for generating a different frequency according to a voltage or current applied thereto, a soft drive circuit 55 for softly driving the frequency IC to raise the frequency generated by the frequency IC during the initial operation and lower the generated frequency to a value near a resonance frequency after the lapse of a predetermined time, and a feedback circuit 56 for raising or lowering the frequency generated by the frequency IC according to the current amount detected by the external current detector 42.

The feedback circuit 56 is connected with the external current detector 42 and is operated in response to the current amount detected thereby to raise the frequency generated by the frequency IC if the detected current amount is greater than a predetermined value and lower the generated frequency if the detected current amount is smaller than the predetermined value.

A detailed description will hereinafter be given of the frequency-varying device 53 with the above-mentioned configuration with reference to FIGS. 4 to 7.

Figure 4:
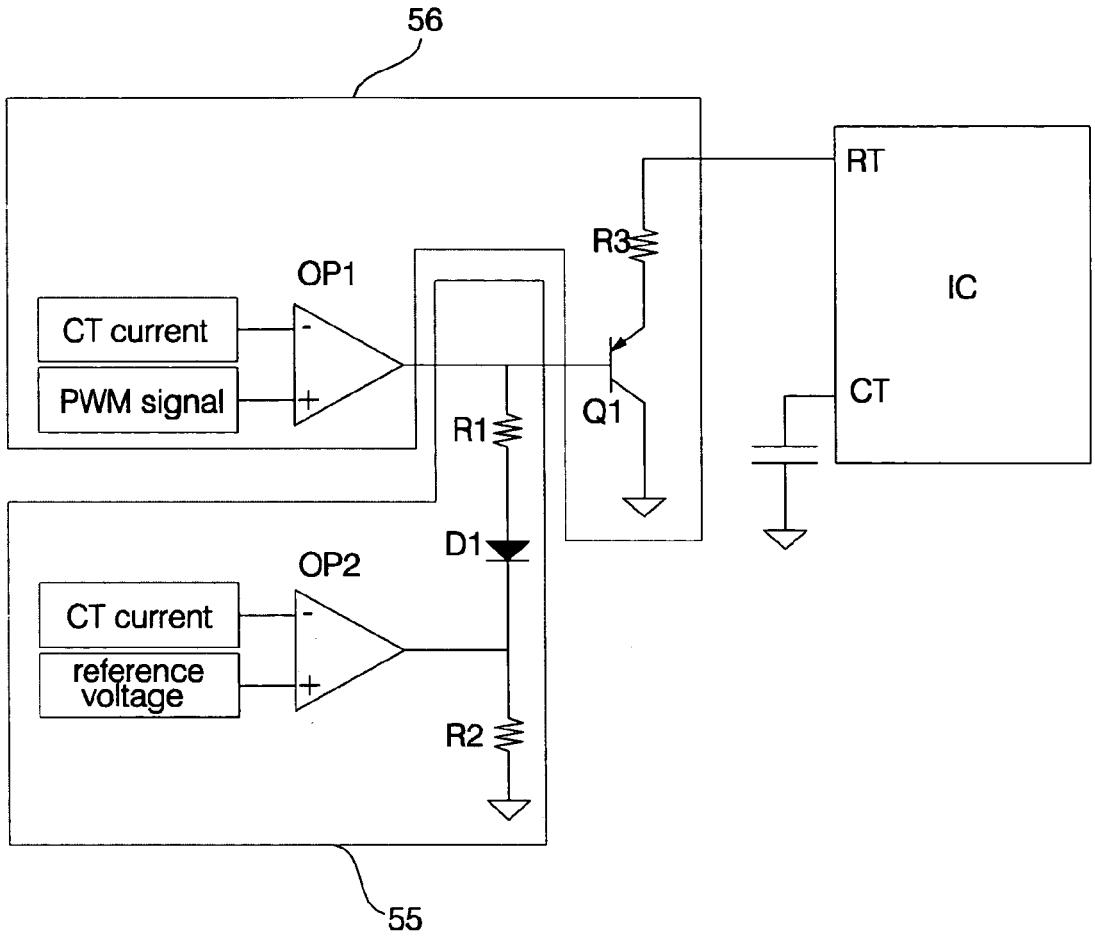
FIG. 4 is a circuit diagram of a first embodiment of a frequency-varying device according to the present invention.
Figure 5:
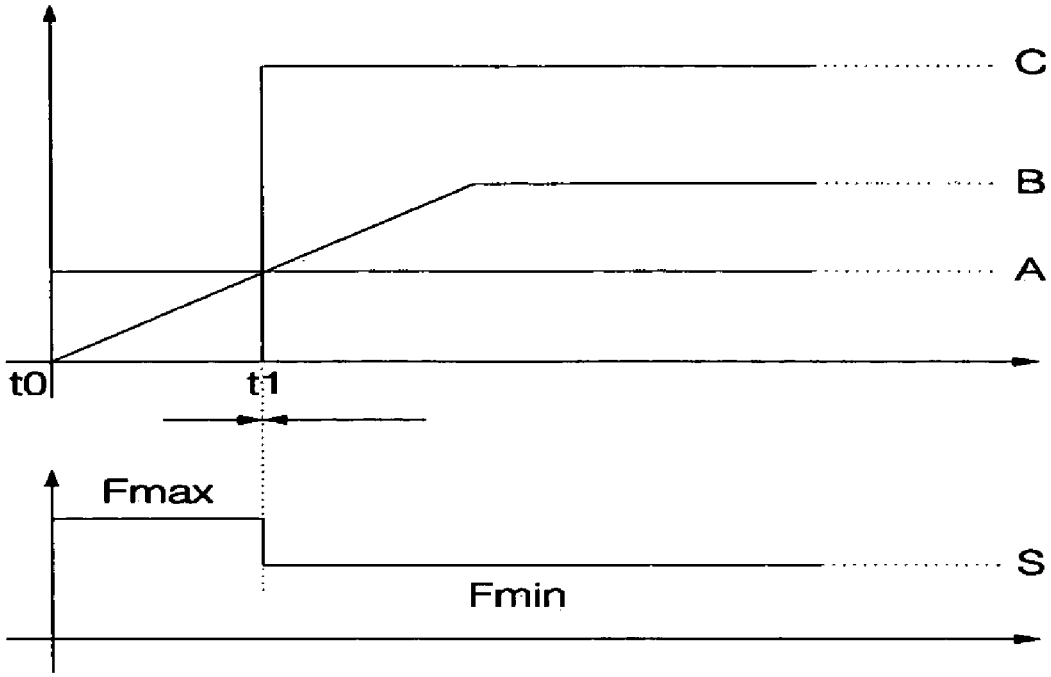
FIG. 5 is a waveform diagram of signals in the frequency-varying device of FIG. 4.

FIG. 4 is a circuit diagram of a first embodiment of the frequency-varying device 53 according to the present invention and FIG. 5 is a waveform diagram of signals in the frequency-varying device 53 of FIG. 4.

In the first embodiment, the frequency-varying device 53 includes the feedback circuit 56, the soft drive circuit 55 and the frequency IC. The feedback circuit 56 includes a first amplifier OP1 having its non-inverting terminal connected to the frequency generator 41 and an inverting terminal for receiving current flowing through a capacitor connected to the frequency IC, and a transistor Q1 having its base connected to an output terminal of the first amplifier OP1 and its emitter connected to the frequency IC.

The soft drive circuit 55 includes a second amplifier OP2 having its non-inverting terminal for receiving the current flowing through the capacitor CT connected to the frequency IC and its inverting terminal for receiving a reference voltage, and a diode D1 having its cathode connected to an output terminal of the second amplifier OP2.

In the frequency-varying device 53, the capacitor current B applied to the non-inverting terminal of the second amplifier OP2 is smaller in amount than current A of the reference voltage applied to the inverting terminal of the second amplifier OP2 during the initial operation of the inverter microwave oven.

As a result, the second amplifier OP2 outputs a low-level voltage C at its output terminal, so the diode D1 conducts. As the diode D1 conducts, current flows through resistors R1 and R2, thereby causing the capacitor CT of the frequency IC to rapidly charge and discharge. Consequently, the frequency IC outputs a high-frequency signal S.

Meanwhile, as the above circuitry is operated, the current B flowing through the capacitor CT of the frequency IC increases in amount. As a result, the capacitor current B applied to the non-inverting terminal of the second amplifier OP2 becomes larger in amount than the current A of the reference voltage applied to the inverting terminal of the second amplifier OP2 beginning with a time t1 where they are equal.

Accordingly, the second amplifier OP2 outputs a high-level voltage C at its output terminal, so the diode D1 does not conduct. As a. result, since no current flows through the resistors R1 and R2, the capacitor CT of the frequency IC charges and discharges at a speed lower than that during the initial operation. Consequently, the frequency IC outputs a signal S of a low frequency near the resonance frequency.

Figure 6:
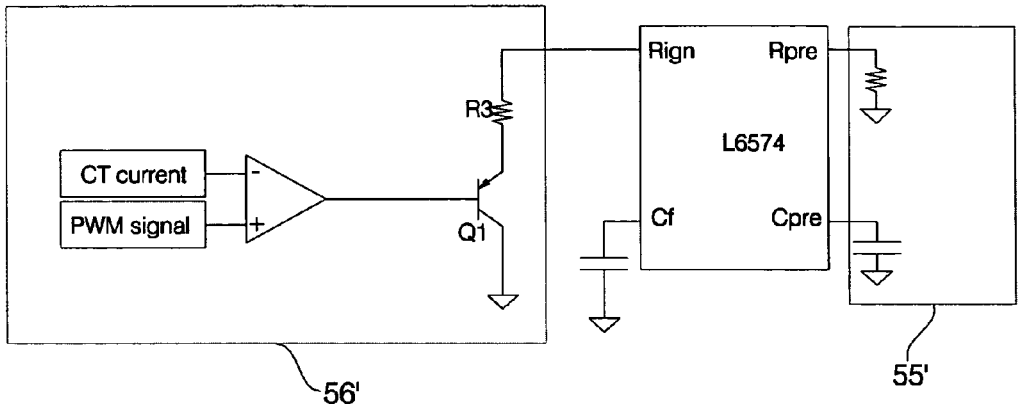
FIG. 6 is a circuit diagram of a second embodiment of the frequency-varying device according to the present invention.
Figure 7:
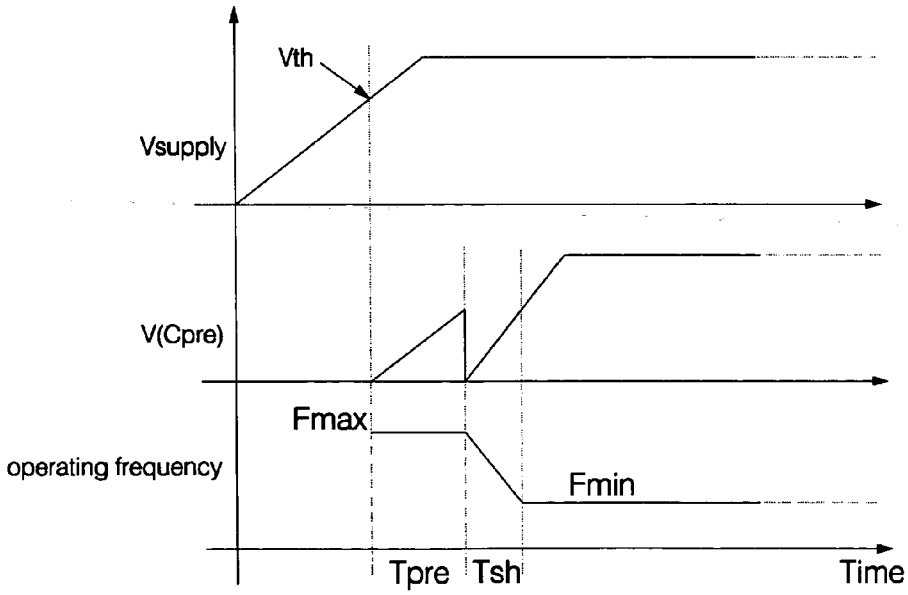
FIG. 7 is a waveform diagram of signals in the frequency-varying device of FIG. 6.

FIG. 6 is a circuit diagram of a second embodiment of the frequency-varying device 53 according to the present invention and FIG. 7 is a waveform diagram of signals in the frequency-varying device 53 of FIG. 6.

In the second embodiment, the frequency-varying device 53 includes an IC for generating a frequency signal, as well as performing the same function as that of the soft drive circuit in the first embodiment, and a feedback circuit 56'.

The feedback circuit 56' is substantially the same in construction and operation as the feedback circuit 56 in the first embodiment, and a description thereof will thus be omitted.

The IC is an integrated version of the frequency IC and soft drive circuit in the first embodiment. This IC is connected with the feedback circuit 56' and is operated to generate a high-frequency signal during the initial operation of the inverter microwave oven and a low-frequency signal after the lapse of a predetermined time based on capacitance of a capacitor thereof.

In the present embodiment, the IC may be an L6574 IC, which is universally used to control a half-bridge metal oxide semiconductor field-effect transistor (MOSFET) gate for a fluorescent lamp. The following equation 1 can be obtained from a data sheet of the L6574 IC:

$$t_{PRE}=K_{PRE}\times C_{PRE}t_{SH}=K_{FS}\times C_{PRE}\approx 0.1\times t_{PRE}$$

$$K_{PRE}=1.5\text{s}/\mu F K_{FS}=0.15\text{s}/\mu F\approx 0.1\times K_{PRE}$$

$$f_{min}=1.41/(R_{ign}\times C_f)$$

$$f_{max}=\{1.41\times(R_{pre}+R_{ign})\}/(R_{PRE}\times R_{ign}\times C_f) \quad \text{[Equation 1]}$$

Thus, modifying the design value of the L6574 IC on the basis of the above equation 1, it is possible to generate the optimum frequency to prevent overvoltage from being applied to the magnetron during the initial operation of the inverter microwave oven.

The operation of the inverter microwave oven with the above-stated configuration according to the present invention will hereinafter be described with reference to FIGS. 8*a* to 9.

Figure 9:
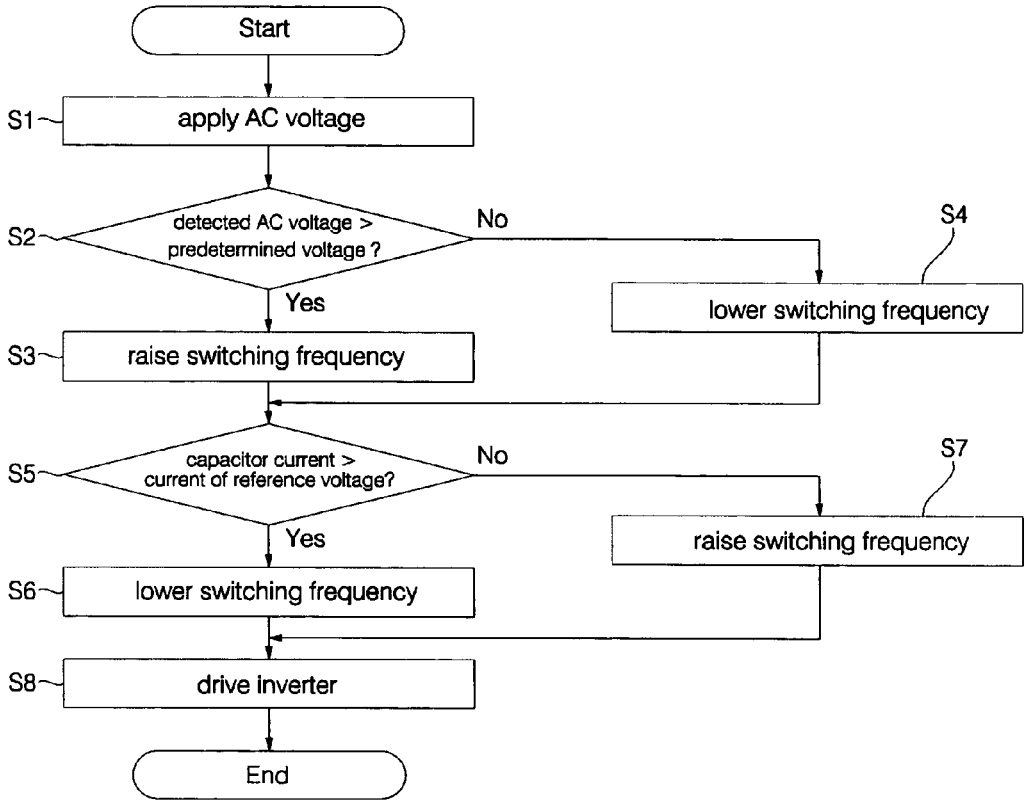
FIG. 9 is a flow chart illustrating a method for controlling the inverter microwave oven according to the present invention.

FIG. 9 is a flow chart illustrating a method for controlling the inverter microwave oven according to the present invention.

First, a commercial AC voltage is inputted to the inverter microwave oven, rectified and smoothed into a DC voltage, and applied to the inverter (S1).

The amount of current of the AC voltage is detected and then compared with a predetermined value (S2). If the detected current amount is determined to be greater than the predetermined value, a frequency generated by the frequency IC is raised (S3). On the contrary, if the detected current amount is determined to be smaller than the predetermined value, the frequency generated by the frequency IC is lowered (S4).

Thereafter, a comparison is made between current flowing through the capacitor connected to the frequency IC and current of a reference voltage (S5). If the capacitor current is determined to be greater in amount than the current of the reference voltage, a low-frequency signal is generated (S6). On the contrary, if the capacitor current is determined to be smaller in amount than the current of the reference voltage, a high-frequency signal is generated (S7).

At this time, the low-frequency signal, generated when the capacitor current is greater in amount than the current of the reference voltage, has a frequency similar to the resonance frequency of the resistor and capacitor connected to the frequency IC, thereby making it possible to improve power efficiency of the inverter microwave oven.

Also, the amount of current flowing through the magnetron is detected and then compared with a predetermined value. If the detected current amount is determined to be greater than the predetermined value, a frequency generated by the frequency generator is raised. On the contrary, if the detected current amount is determined to be smaller than the predetermined value, the frequency generated by the frequency generator is lowered.

Therefore, the switches of the inverter are operated in response to a switching control signal based on the frequency generated in the above manner to generate a magnetron drive high-power AC voltage (S8). The magnetron driver converts the generated high-power AC voltage into a DC voltage and applies the converted DC voltage to the magnetron.

Figure 8A:
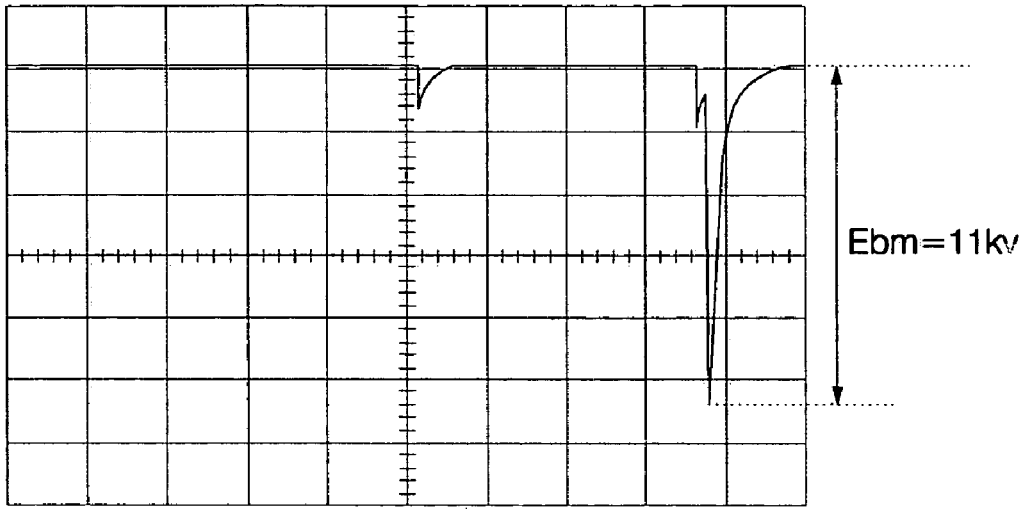
FIGS. 8*a* and 8*b* are waveform diagrams illustrating a comparison between output voltages of the conventional and present inverter microwave ovens.
Figure 8B:
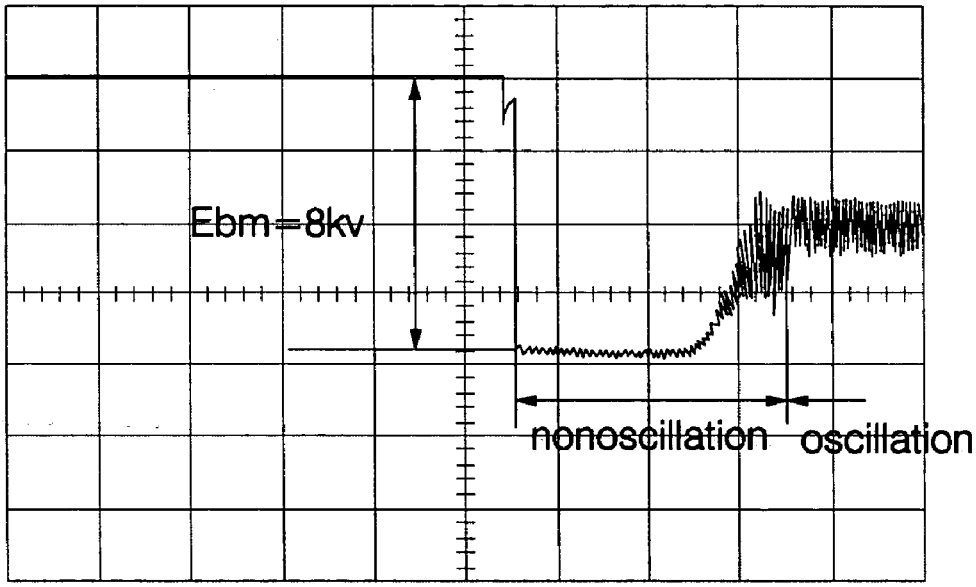

FIGS. 8*a* and 8*b* are waveform diagrams illustrating a comparison between output voltages of the conventional and present inverter microwave ovens.

The conventional inverter microwave oven generates such a high output voltage of about 11 KV during the initial operation as to be beyond the margin of diodes connected to a secondary winding of the magnetron driver, resulting in degradation in durability and reliability of the inverter circuit. However, the present inverter microwave oven generates such a low output voltage of about 8 KV during the initial operation as to greatly improve the durability and reliability of the inverter circuit as compared with the conventional microwave oven.

As apparent from the above description, the present invention provides an inverter microwave oven and a method for controlling the same, wherein a switching frequency of an inverter is raised during the initial operation of the microwave oven and then lowered during the normal operation of the oven after the lapse of a predetermined time, thereby enhancing durability and reliability of the inverter circuit.

Further, in the case where a soft drive circuit is provided according to one embodiment of a frequency-varying device according to the present invention, high withstand voltage characteristics of diodes connected to a secondary winding of a magnetron driver are not required, resulting in a reduction in production cost.

Furthermore, in the case where a soft drive IC is provided according to an alternative embodiment of the frequency-varying device according to the present invention, the same function is performed through the use of only a specific IC device without using an amplifier and a plurality of devices which constitute the soft drive circuit, thereby facilitating the miniaturization of a product and significantly enhancing the price competitiveness thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inverter microwave oven comprising:

a magnetron for generating electromagnetic waves;

an inverter for performing a switching operation based on a direct current (DC) voltage into which a commercial alternating current (AC) voltage is rectified and smoothed, to generate a magnetron drive AC voltage, and applying the generated AC voltage to said magnetron; and inverter control means for varying a switching frequency of said inverter to prevent overvoltage from being applied to said magnetron.

2. The inverter microwave oven as set forth in claim 1, wherein said inverter control means includes:

a frequency generator for generating a reference frequency; and frequency control means for varying said reference frequency generated by said frequency generator to apply a high-power voltage to said magnetron and raising the switching frequency of said inverter during an initial operation of the microwave oven.

3. The inverter microwave oven as set forth in claim 2, wherein said inverter control means further includes:

an external current detector for detecting the amount of current of said commercial AC voltage; and a magnetron current detector for detecting the amount of current flowing through said magnetron.

4. The inverter microwave oven as set forth in claim 3, wherein said frequency control means includes frequency-varying means for varying the switching frequency of said inverter according to the current amount detected by said external current detector.

5. The inverter microwave oven as set forth in claim 4, wherein said frequency control means further includes:

an inverter driver for applying a switching control signal to said inverter in response to an output signal from said frequency-varying means to control the switching frequency of said inverter so as to drive said inverter; and an output controller for raising said reference frequency generated by said frequency generator if the current amount detected by said magnetron current detector is greater than a predetermined value and lowering said reference frequency if the detected current amount is smaller than the predetermined value.

6. The inverter microwave oven as set forth in claim 5, wherein said frequency-varying means includes:

a frequency integrated circuit (IC) for generating a different frequency according to a voltage or current applied thereto; and a soft drive circuit for softly driving said frequency IC to raise said frequency generated by said frequency IC during the initial operation and lower the generated frequency after the lapse of a predetermined time.

7. The inverter microwave oven as set forth in claim 6, wherein said frequency-varying means further includes a feedback circuit responsive to the current amount detected by said external current detector for raising said frequency generated by said frequency IC if the detected current amount is greater than a predetermined value and lowering the generated frequency if the detected current amount is smaller than the predetermined value.

8. The inverter microwave oven as set forth in claim 7, wherein said feedback circuit includes an amplifier having its non-inverting terminal connected to said frequency generator and an inverting terminal for receiving current flowing through a capacitor connected to said frequency IC.

9. The inverter microwave oven as set forth in claim 7, wherein said soft drive circuit includes:

an amplifier having its non-inverting terminal for receiving current flowing through a capacitor connected to said frequency IC and its inverting terminal for receiving a reference voltage; and a diode having its cathode connected to an output terminal of said amplifier.

10. The inverter microwave oven as set forth in claim 5, wherein said frequency-varying means includes a soft drive IC for generating a high-frequency signal during the initial operation and a low-frequency signal after the lapse of a predetermined time.

11. The inverter microwave oven as set forth in claim 10, wherein said frequency-varying means further includes a feedback circuit responsive to the current amount detected by said external current detector for raising a frequency generated by said soft drive IC if the detected current amount is greater than a predetermined value and lowering the generated frequency if the detected current amount is smaller than the predetermined value.

12. The inverter microwave oven as set forth in claim 10, wherein said soft drive IC is an L6574 IC.

* * * * *